US007370586B2

(12) United States Patent
McHale et al.

(10) Patent No.: US 7,370,586 B2
(45) Date of Patent: May 13, 2008

(54) RAIL TRACK DELIVERY AND REMOVAL

(75) Inventors: Pat McHale, York (GB); Richard Davies, York (GB)

(73) Assignee: Fastline Limited, York (GB)

( * ) Notice: Subject to any disclaimer, the term of this patent is extended or adjusted under 35 U.S.C. 154(b) by 288 days.

(21) Appl. No.: 11/054,675

(22) Filed: Feb. 9, 2005

(65) Prior Publication Data

US 2005/0279239 A1 Dec. 22, 2005

(30) Foreign Application Priority Data

Feb. 9, 2004 (GB) ..... 0402643.1

(51) Int. Cl.
*B65G 67/00* (2006.01)

(52) U.S. Cl. ..... 104/2; 410/44; 414/339

(58) Field of Classification Search ..... 104/2, 104/3, 5, 7.1, 7.2, 15; 410/44, 45
See application file for complete search history.

(56) References Cited

U.S. PATENT DOCUMENTS 1,826,069 A 10/1931 Guilbert et al.
3,288,082 A * 11/1966 Brosnan ..... 104/2
4,253,398 A * 3/1981 Theurer et al. ..... 104/2
5,174,211 A 12/1992 Snead
5,595,313 A 1/1997 Kroll et al.
5,630,365 A * 5/1997 Hertelendi ..... 104/5

FOREIGN PATENT DOCUMENTS

| | | |
|---|---|---|
| DE | 800 975 | 12/1950 |
| FR | 1 574 169 | 11/1969 |
| FR | 2 728 285 | 6/1996 |
| WO | WO 03/068656 | * 8/2003 |

* cited by examiner

*Primary Examiner*—Mark T. Le
(74) *Attorney, Agent, or Firm*—Adams Intellectual Property Law, P.A.

(57) ABSTRACT

A method of transporting rails to, and leaving the rails at, a target location. The method includes using a train having multiple rail wagons. The steps include supporting the rails on at least two successive wagons with the rail being movable relative to at least one wagon in the direction of elongate extent of the rail, and using winches on the wagons to unload the rails at the target location.

22 Claims, 6 Drawing Sheets

RAIL TRACK DELIVERY AND REMOVAL

TECHNICAL FIELD AND BACKGROUND OF THE INVENTION

The present invention relates to rail roads. In particular, although not exclusively, the present invention relates to a method and apparatus for delivering and/or removing rails and sleepers forming parts of a rail track at a desired location.

Conventional railway track is well known. The track typically includes a pair of spaced apart metal rails rigidly held parallel to each other and resting on sets of sleepers which are positioned at regular intervals along a main length of the rails. The rails are rigidly held on the sleepers by means of connections known as furniture. Many different types of material are known for the use of forming sleepers. For example wood, steel and concrete sleepers are well known.

In the past when new track has been laid the ground at a desired location has been prepared and then sleepers have been transported via road or rail from a manufacturing or holding point to that location and then unloaded and positioned. Subsequently a further train or possibly lorry has carried rails to the desired location and these have been unloaded and located by hand at the work site. A number of disadvantages occur with such methods.

DE 800 975 (Renz), U.S. Pat. No. 1,826,069 (Legrand), FR 2 728 285 (Travaux), FR 1 574 169 (Durand), U.S. Pat. No. 5,174,211 (Snead) and U.S. Pat. No. 5,595,313 relate to rail laying methods in which track can be laid.

One particular disadvantage is that the provision of new rail track has been an extremely laborious process requiring many skilled individuals not only to carry out the physical lifting and moving operation of sleepers and rails but also to maintain safety at a location. Also where rail track is to be required and/or replaced a part of a rail line must be withdrawn from service for a period of time whilst the work is carried out. This can be a costly process for the maintenance service provider.

SUMMARY OF THE INVENTION

It is an aim of embodiments of the present invention to at least partly mitigate the above-mentioned problems.

It is another aim of the present invention to improve the speed of laying or renewal or removal of rails and sleepers which make up rail track.

It is a further aim of the present invention to provide a method and apparatus for deploying rails and/or sleepers via a single train in lengths far exceeding prior art trains. This improves the overall efficiency and speed and reduces costliness.

According to a first aspect of the present invention a method of transporting railway track apparatus to or from a target location comprises using a train including a multiple of rail wagons and at least one elongate member associated with the rail track apparatus being carried by the train which member extends to and is supported by at least three adjacent rail wagons, characterised in that the member is moved relative to the rail wagons via at least one hoist mounted on the same wagons that the member extends over and the hoists act simultaneously to lift the elongate member.

According to another aspect of the present invention there is provided a method for providing railway track rails at a target location comprising: via a train comprising a multiple of rail wagons, carrying a multiple of rails each having a length greater than a wagon length to the target location; and unloading the rails from the wagons at the target location which may be done via a multiple of crane hoists disposed on the wagons.

The method may further comprise providing sliding means which may comprise support rollers at predetermined locations on the wagons, and resting rails, carried by the train during a journey to the target location, on the rollers; whereby if the train deviates from a straight path free movement in the longitudinal position of at least a portion of each rail is afforded with respect to the wagons.

The method may further comprise: releasably securing each rail carried by the train in at least one region of the rail during a journey to the target location such as by securing each the rail by clamping each the rail in a region comprising at an intermediate position such as substantially central position in a lengthwise direction of the rail and allowing end regions of each rail to remain substantially free from constraint.

The method may further comprise: providing sleepers for a railway track at the target location via the steps of: via the train, carrying a plurality of rail sleepers to the target location simultaneously with the carrying of the rails. The steps of providing sleepers may further comprise the step of: unloading the sleepers at the target location via the crane hoists prior to the step of unloading the rails.

The method may further comprise the steps of: on each wagon, carrying a sufficient number of sleepers to the target location to provide a predetermined ratio of sleepers to rails for each rail carried by the train. The method may further comprise: on at least one wagon, carrying extra sleepers to provide a predetermined number of sleepers at locations corresponding to positions located between wagons as rails are unloaded at the target location. Each rail carried by the train may have a length in excess of 300 ft. or 500 ft.

According to another aspect of the present invention, railway track transporting apparatus includes a train including a multiple of rail wagons and at least one elongate member associated with the rail track apparatus being carried by the train, the elongate member extending to and being supported by at least three adjacent rail wagons, characterised in that each wagon that the member extends over includes at least one hoist arranged, in use, to lift the member with each hoist being arranged to act simultaneously to lift the elongate member.

According to a fourth aspect of the present invention there is provided a rail wagon for deployment of railway track rails at a target location comprising: a flat bed for supporting the rails during a journey to the target location and one or more bogies supporting the flat bed; at least one crane hoist for lifting a rail from or to a loaded position on the wagon; and rail locating apparatus for positioning each rail supported by the flat bed in a longitudinal direction along a length of the wagon, each rail having a length greater than a length of the wagon.

The rail wagon may further comprise: rail locating apparatus comprising a plurality of rollers at predetermined locations on the wagon arranged so that rails carried by the wagon rest on the rollers during the journey. The rollers may be arranged to roll around a longitudinal axis perpendicular to a length of a rail carried by the wagon.

The rail wagon may further comprise: rail securing apparatus located in a middle region of the wagon and arranged to releasably secure rails carried by the wagon in at least one region of the rail during the journey. The rail securing apparatus may comprise a clamp device arranged to clamp at least one rail in a region comprising a substantially central position of the rail in a lengthwise direction. The rail securing apparatus may further comprise a plurality of partitioning elements arranged to locate rails carried by the wagon at predetermined transverse locations with respect to the wagon. Each partitioning element may comprise a plate member extending upwardly away from the flat bed and lengthwise along substantially the whole length of the wagon.

The rail wagon may further comprise: sleeper locating apparatus for locating a plurality of sleepers on the wagon during the journey to the target location. The rail wagon may further comprise sleeper securing apparatus for releasably securing each sleeper located on the wagon.

A train may comprise a plurality of wagons as herein referred to and may further comprise a generator car for the supply of power to the wagons.

According to a third aspect of the present invention there is provided a method of laying rail track comprising spaced apart metal rails rigidly held parallel to each other and supported by a plurality of sleepers positioned at regular intervals along a main length of the rails at a target location, comprising the steps of: providing rails to the target location via a train comprising a plurality of wagons, each the rail having a length in excess of a wagon length; and unloading two rails from the train onto sleepers suitably located at a track site which may be effected via a plurality of crane hoists disposed on the wagons.

The method may further comprise: subsequently advancing the train and unloading two further rails from the train onto further sleepers at a further track site immediately adjacent to the track site, the two further rails being positioned next to and extending from the two rails already located during a prior unloading step so as to form a portion of railtrack.

The method may further comprise: prior to the steps of providing rails at the target location, unloading sleepers from the train at desired locations onto a prepared rail bed.

The method may further comprise: repeating steps of advancing the train and unloading further sleepers from the train at track sites adjacent a track site of a preceding unloading step until substantially all sleepers loaded on the train have been unloaded.

According to a fourth aspect of the present invention there is provided a method for removing rails from a target location comprising the steps of: via a train comprising a plurality of rail wagons lifting rails resting on sleepers at a target location, for instance via a plurality of crane hoists disposed on the wagons, the rails having a main length in excess of a wagon length; loading the lifted rails onto the wagons of the train; and carrying the rails away from the target location via the train.

Embodiments of the present invention provide the advantage that lengths of up to 700 ft. of rail can be transported either to or away from a location where rail is laid. By providing a system which can manipulate such long lengths of rail and yet which is still able to be transported via the rail network (with its associated curves and inclines) a very efficient method and apparatus is provided.

Embodiments of the present invention also provide a method and apparatus by which a single train including many wagons can be used to transport a number of long rails together with an appropriate number of sleepers to be used with those rails. This prevents the need for multiple journeys or multiple trips of a single train between a supply node and a desired location. The train may therefore be driven to a desired location where workmen are located to carry out track laying or track removal. As a result of the work crews can work very efficiently and the time which is required to withdraw an area of track from use can be much reduced.

BRIEF DESCRIPTION OF THE DRAWINGS

Embodiments of the present invention will now be described hereinafter, by way of example only, with reference to the accompanying drawings, in which.

In the drawings like reference numerals refer to like parts.

DETAILED DESCRIPTION OF THE PREFERRED EMBODIMENT AND BEST MODE

Figure 1:
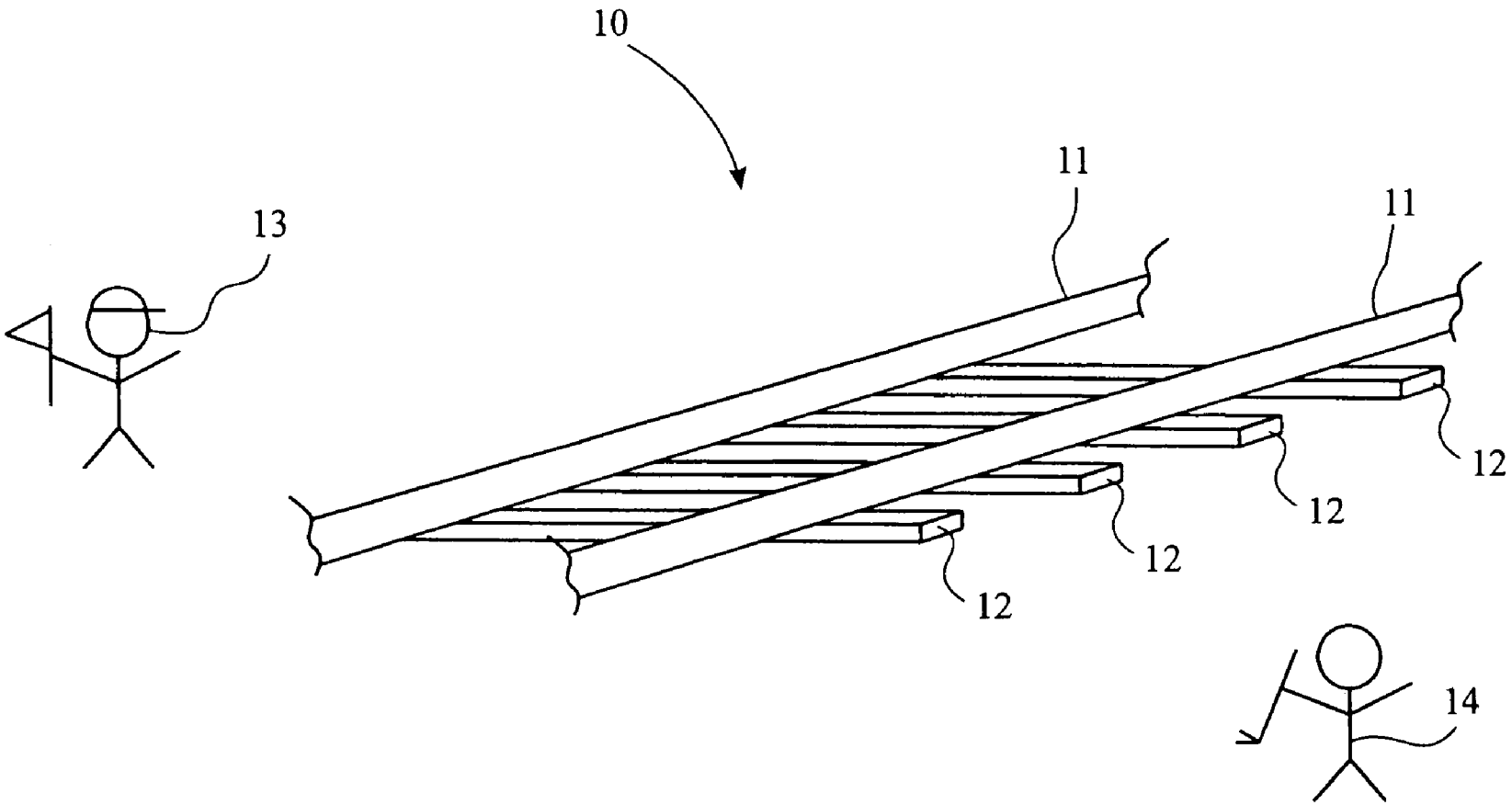
FIG. 1 illustrates schematically an area of rail track at a target location.

FIG. 1 illustrates a target location 10 where rail track including rails 11 and sleepers 12 are located. The rails are spaced apart in a parallel fashion and rest upon the sleepers which are positioned at regular intervals along a main length of the rails. The rails are secured to the sleepers by connections as is known in the art. The sleepers themselves rest upon a rail bed and are often packed after careful positioning, with ballast which comprises stone chippings.

Workmen such as a lookout 13 or worker 14 are positioned at the target location when the track (comprising the rails and the sleepers) is to be removed or to be laid. The target location can be just a small portion or area extending just the length of one rail or may be a long stretch of ground where many rails are to be laid end on end.

The following specific embodiments will be described with respect to the laying process of track at a target location 10. It will be understood that embodiments of the present invention can likewise be used to remove old rails and sleepers from a target location in a similarly convenient manner.

Figure 2:
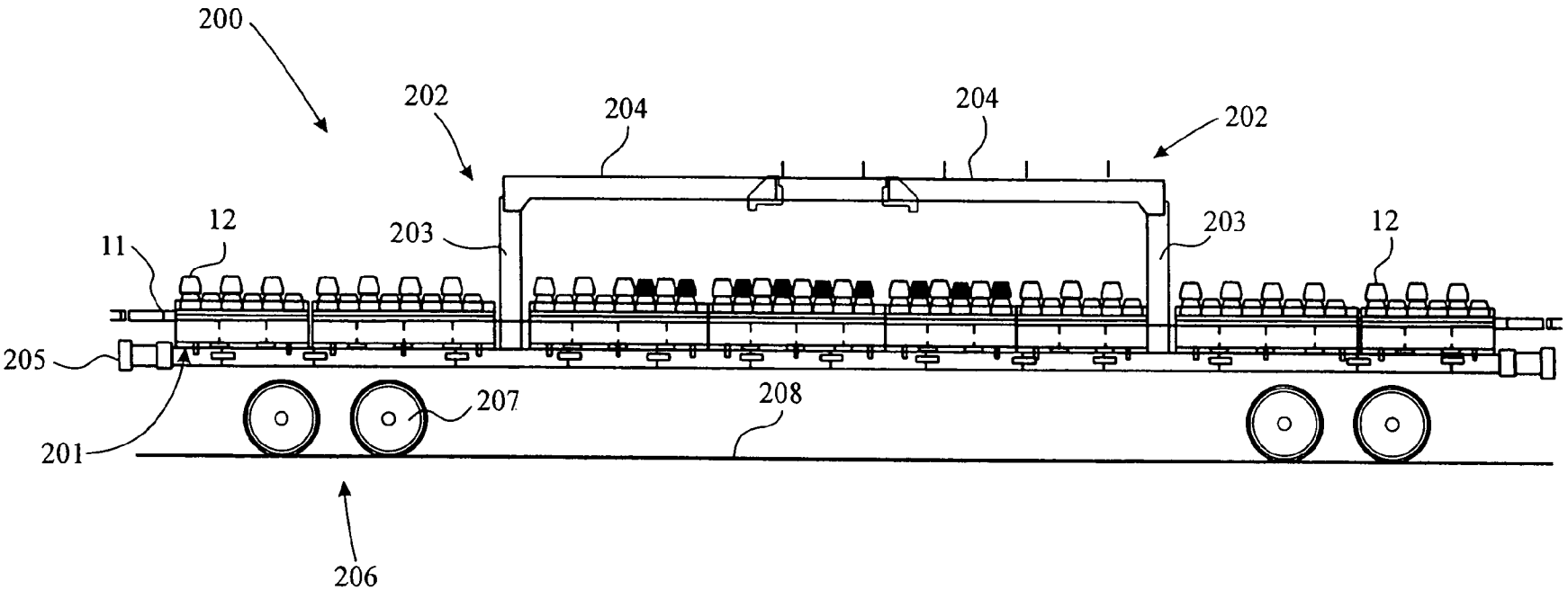
FIG. 2 illustrates a side view of a rail wagon.

FIG. 2 illustrates a slide view of a track deployment wagon 200. The wagon 200 comprises a flat bed railway transporting cargo truck having a chassis forming a flat bed 201 upon which cargo may be mounted either directly or via pallets which themselves may be mounted on the flat bed. Two crane hoists 202 are fixed to the wagon. It will be understood that one or more hoists may be provided on each wagon. Each hoist includes an upright support structure 203 which may be formed from a reinforced metal girder and which extends substantially perpendicular to the flat bed surface. Each hoist also includes an arm 204 which extends transversely outwards from a region of the support 203. In FIG. 2 the arms are shown aligned along a main length of the wagon and may be secured together in that position when the wagon is moved. When the hoists are to be used to lift sleepers and/or rails from or to the flat bed the arms of each hoist are swung from the storage position to an operating position in which the arm is substantially perpendicular to the main length of the wagon.

Sleepers 12 are positioned at predetermined points on the wagon. Rails 11 may also be transported and these are loaded in a direction parallel with the main length of the wagon along its whole length. The rails may in fact be longer than the wagon length and such rails are supported by multiple wagons 200 arranged end to end to form a train. A single rail may be supported by two or three or more wagons and may be supported by all of the wagons.

The wagon 200 also includes buffers 205 and two bogies 206 which support wheels 207 to enable the wagon to roll on railway lines 208.

Figure 3:
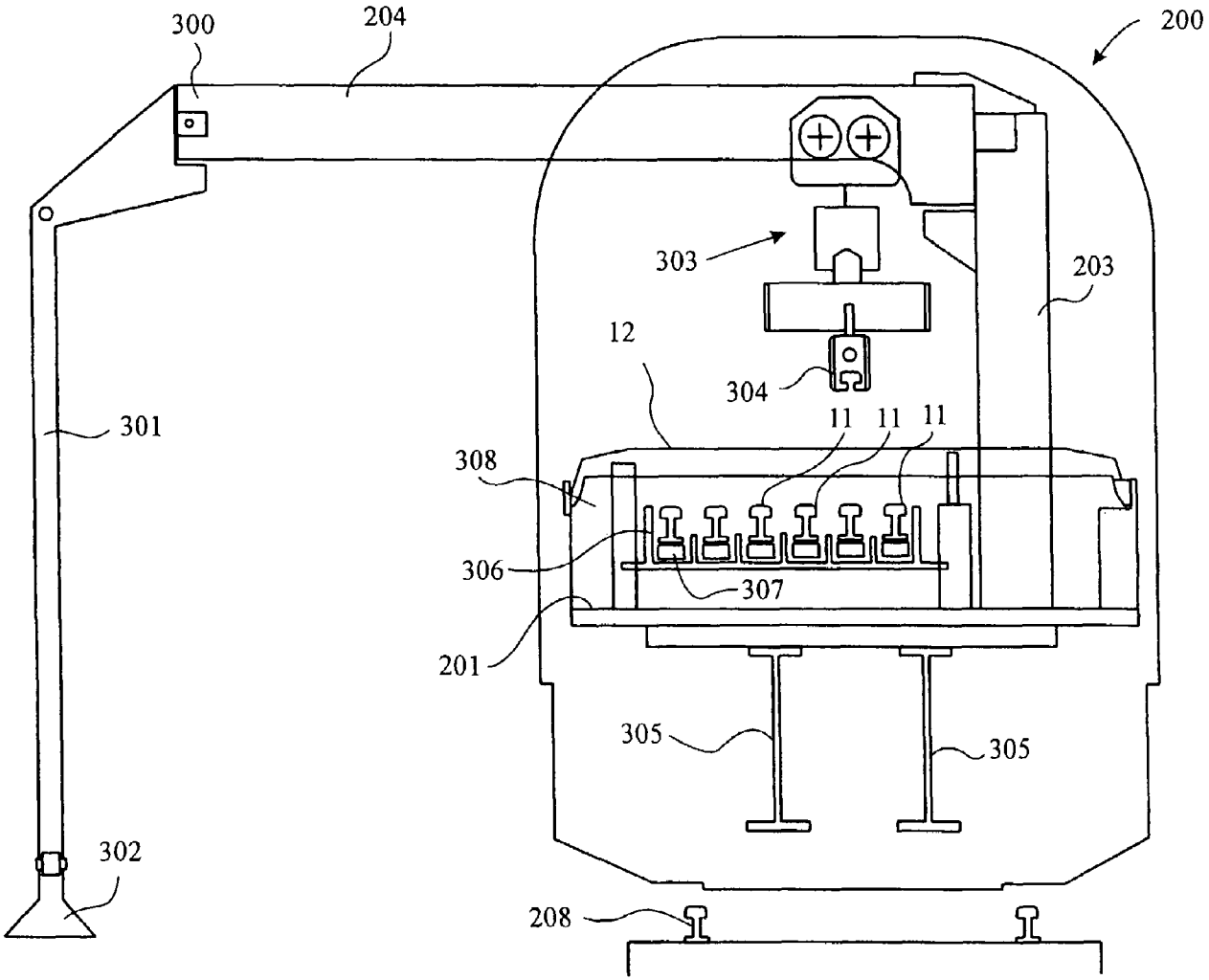
FIG. 3 illustrates a portion of a wagon for transporting and loading/unloading rail and sleepers.

FIG. 3 illustrates a cross-section through the wagon 200 when the hoist arm 204 is swung out to the operating position. In this operating position a distal end 300 of the arm is supported by an outrigger 301 which is a height adjustable leg which may be supported via a foot 302. The hoist 202 includes a movable winch 303 which is mounted on the extendable arm 204. The winch 303 may be operated remotely by a user to run along the length of the arm 204. The winch includes a claw 304 which has jaws which can open and close to grasp sleepers or rails. In order to do this the winch is also arranged to lower or raise the claw.

The chassis of the wagon includes box-like girders 305 which provide rigidity for the wagon upon which the flat bed 201 is located. Rails 11 may be carried by the wagon when loaded into a rail support structure 306 supported on the flat bed 201. The support structure is described in more detail with respect to FIGS. 4 and 5. The rails are loaded onto the wagon either when they are removed from a work site or, when new rails are to be laid, from a manufacturing or storage site. The rails are loaded in a longitudinal direction along the length of the wagon (in and out of the page of FIG. 3). Each rail rests upon a roller or rollers 307 spaced along the train. The rollers 307 may be separate for each rail or may be longer rolling elements which extend under two or more of the rails. Sleepers 12 are loaded on the wagon in a direction across the width of the flat bed 201. The sleepers are kept in place at predetermined locations on the wagon by suitable notches or other locating devices formed in the support structure 308 which extends upwardly away from the flat bed 201. Once loaded each sleeper may be locked in place via a releasable securing mechanism so that the sleepers do not fall of the wagon when it moves.

Figure 4:
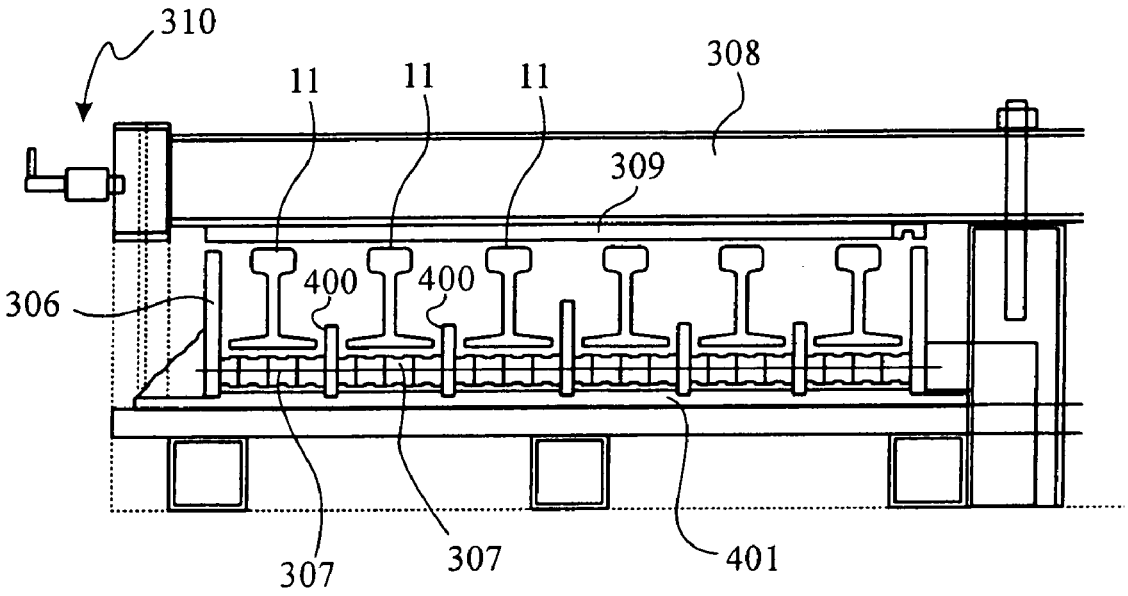
FIG. 4 illustrates rails being transported.
Figure 5:
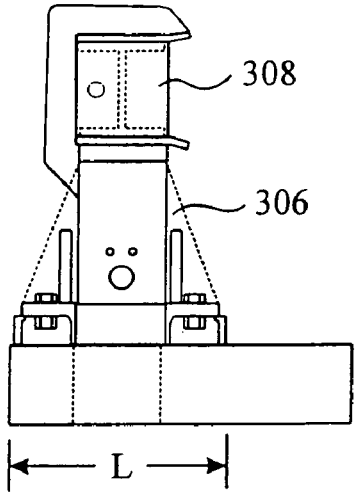
FIG. 5 illustrates a portion of a rail locating member.

As noted in FIG. 4 the rails 11 are supported on rollers 307 which roll about a longitudinal axis perpendicular to the direction in which the loaded rails extend. It will be understood that rather than rollers any device which permits the rail to slide in a direction into the page (and along the main length of the wagon) may be used in embodiments of the present invention. For example a greased surface providing limited frictional contact with the underside of the rails would suffice. The rail support structure 306 includes rail locating uprights 400 which extend upwardly from a base 401 of the rail support structure 306 at predetermined locations. The rail support structure may extend substantially along the whole length of the wagon or more preferably as shown in FIG. 5 may have a relatively short width L with a number of such support structures being fixed to the flat bed 201 of the wagon at predetermined locations. A lid 308 to which is affixed a thick rubber mat 309 may be locked in place via a securing pin 310 once rails have been loaded onto the wagon. It will be understood that whilst six rails are indicated as being loaded onto the wagon one or more rails may be carried as desired. As illustrated in FIG. 5 rather than a lid 308 which extends along a substantial length of the wagon a locking bar 308 may be used across the rails to secure the rails in place during transportation.

Since the rails are rested on a low friction element during transportation, as a train (formed by wagons arranged end to end and a generator car for supplying power to the wagons) is transported on a journey from or to a work site forming a target location where rails are to be removed or delivered, the train will travel around a curved path and possibly along an inclined path. If the rails were fixed in place along the length of the wagons the natural stiffness and rigidity of rails which extend between wagons would prevent the proper movement of the train. However according to embodiments of the present invention when the train deviates from a straight path the rails may be permitted to curve because they can move substantially freely in a longitudinal direction along the main length of the wagon. Thus the ends of rails supported on the wagons on the inside of a curve will extend whilst rails on the side of the wagons on the outside of a curve will tend to move towards a central point of respect to the position of the rail when the wagon is heading in a straight path.

It is preferable that the rails are locked in position so that they can not possibly fall from the wagon. However if the rails are locked along their length the above-mentioned movement would be impossible and thus the wagons would not be permitted to transport long lengths of rail because the wagon would not be able to maneuver along rail track which was curved or inclined.

Figure 6:
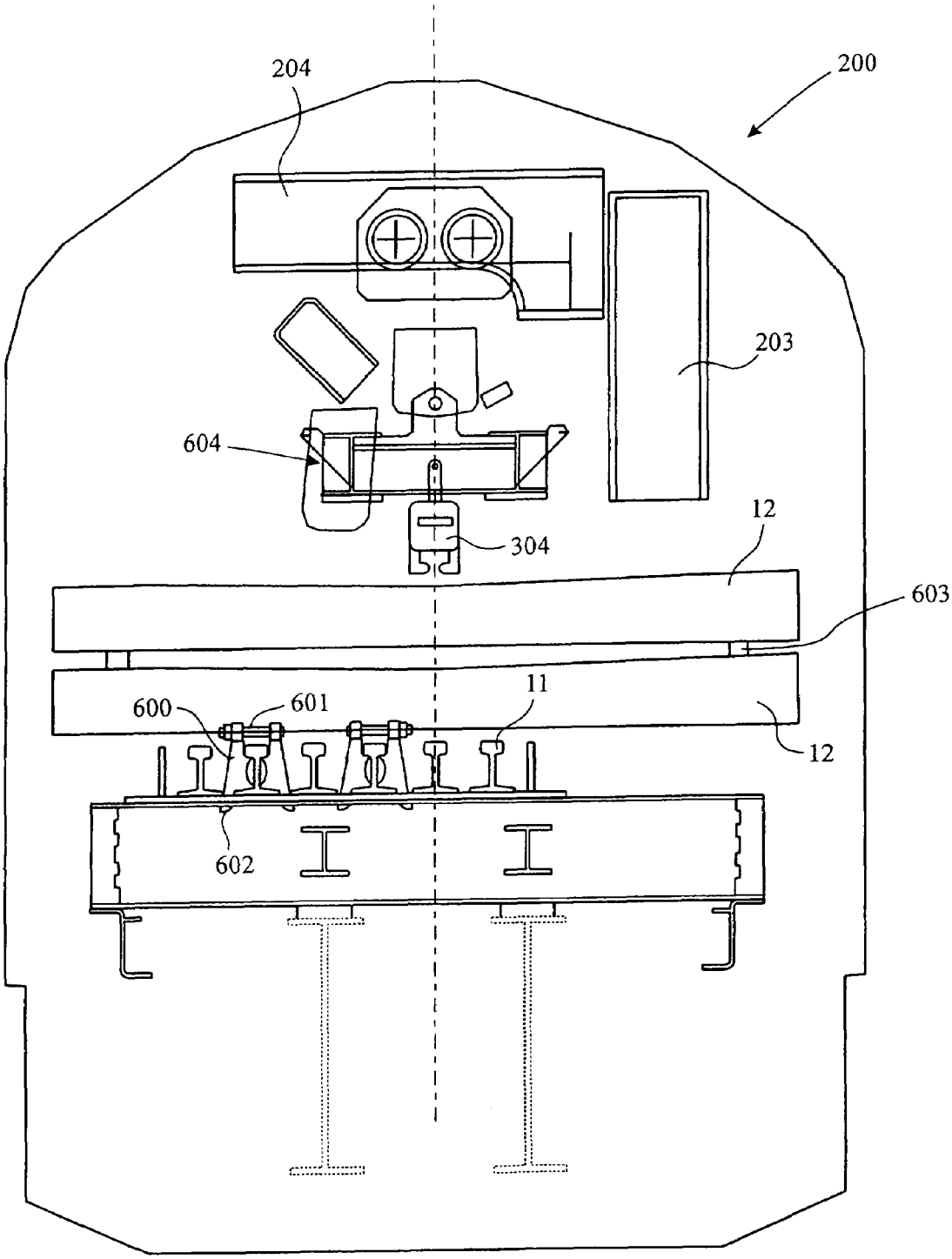
FIG. 6 illustrates a clamping device.

FIG. 6 illustrates how the rails may be secured at one point on the wagon to prevent rails falling off. It will be understood that the pallet on which the rail and sleepers are carried (as shown more clearly in FIG. 3) are not shown for the purposes of clarity in FIG. 6. The point at which each rail is secured is preferably in a central region of the rails which then permits each end of the rail to move freely unconstrained. Each rail may be releasably secured via any suitable means. For example, as shown in FIG. 6, jaws 600 which are configured to engage with a rail may be locked together via a screw mechanism 601. The jaws 600 have flat bed engaging lugs 602 which secure the jaws and thus the rails to the flat bed. Each rail may be releasably secured at a similar position at a clamping point on a part of a wagon in the middle of a train. Alternatively the clamping devices may be staggered either on the same wagon or even possibly on different wagons. Of course more than one securing point may be used on the train to secure each rail at more than one position.

The same methods as described above in relation to the rails apply to the sleeper lifting bar 604 that will be described below and any of the features for the rail in relation to its mounting on the wagon could be used for the rail.

As illustrated in FIG. 6, sleepers 12 may be stacked above the rails across the width of the wagon. The sleepers may be in a single layer or may be stacked on tope of one another in which case spacers 603 are duly located between the sleepers. Sufficient sleepers are carried on the wagons so that a desired ration of sleepers to rails is carried on the train. This ensures that with a single train journey rails and corresponding sleepers may be delivered to a target location where workmen can unload the sleepers and rails. Rather than lift the sleepers individually the hoist 303 includes a sleeper lifting bar 604 which extends along substantially the whole length of the wagon or over a length greater than the wagon or over a plurality of wagons or over all of the sleepers. The bars may be more than 300 feet or more than 500 feet long. The bar may be slidably mounted in the hoists to allow the train to go around corners. The bar may be fixed at one or more points along its length. The bar 604 is formed from a rigid box girder construction and may be lowered to a position just above the sleepers loaded on the wagon. At this point in time a user can climb onto the wagon and connect each of the sleepers, aligned in a row on the wagon, to the bar 604. This connection may be made at the worksite.

By then raising the hoist 303 the bar 604 and thus all sleepers attached to the bar can be lifted in one step. Another advantage is that the bar 604 can include sleeper lifting points at predetermined spaces so that when the set of sleepers is lifted, moved outwardly along the arm 204 and then lowered onto a prepared rail bed the sleepers are placed on the ground at predetermined spacings. Likewise sleepers existing at a target location may be simultaneously lifted and placed on the wagon. It will be understood that the lifting bar 604 is not required when lifting rails. Rather the hoist jaw 304 can be used on one or each wagon.

It can be seen that the lifting bar comes down from above, thus allowing a set or a layer of sleepers to be picked and placed followed by the rails.

Figure 7:
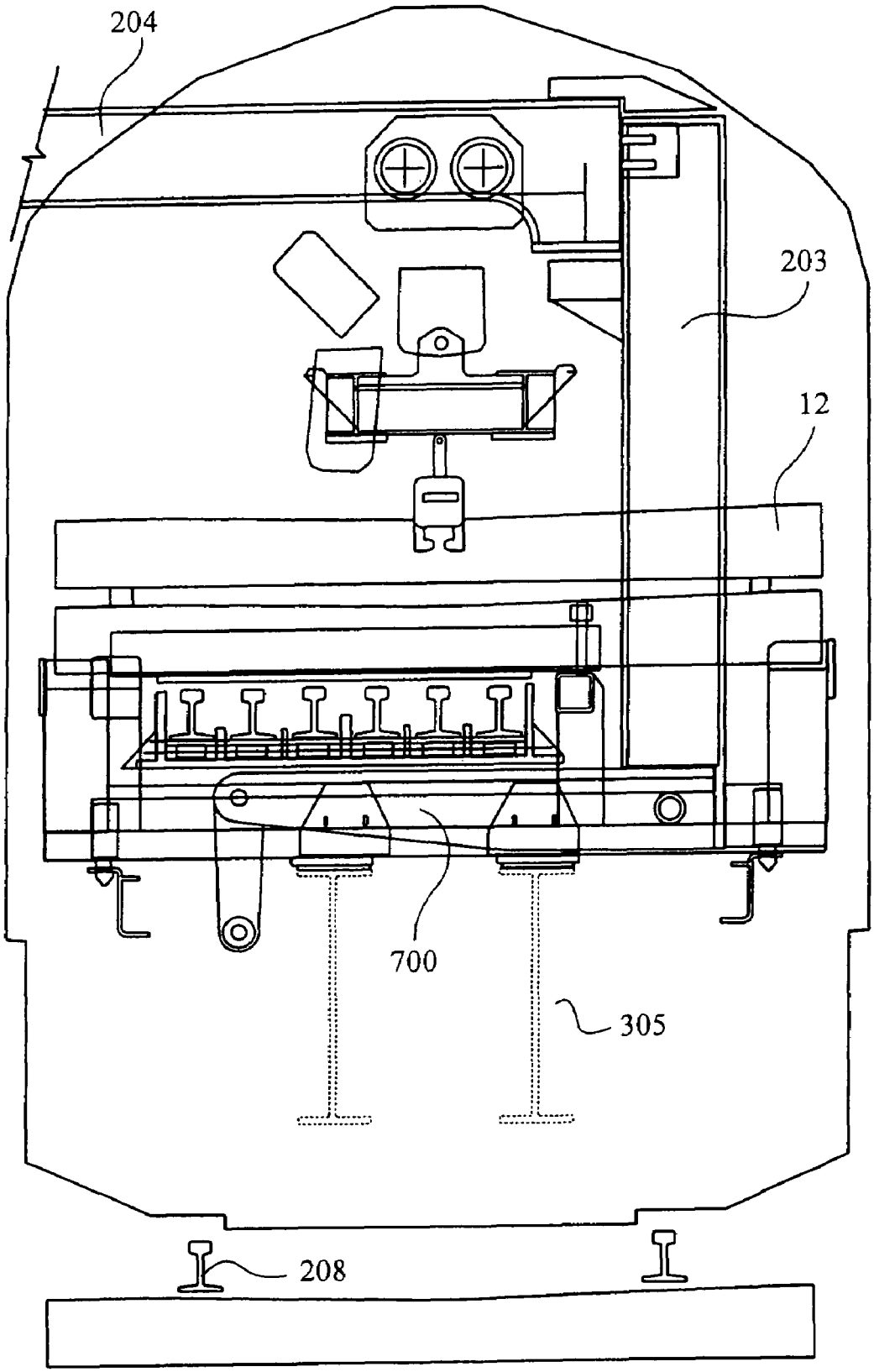
FIG. 7 illustrates a portion of a wagon in more detail.

FIG. 7 illustrates a portion of the wagon in more detail and illustrates how rails and sleepers may be carried to and from a target location resting upon a pallet 700. The pallet provides a convenient way for loading/unloading equipment on the wagon bed.

The rails may be more than 300 or more than 500 feet long.

Embodiments of the present invention provide a very convenient way in which rails and appropriate numbers of sleepers may be transported to or from a location where track is to be laid or removed respectively. Alternatively the plurality, or a multiple, of wagons can be used to transport only sleepers or only rails to or from a desired location. As a result the wagons themselves provide a very versatile piece of equipment for rail track maintenance service providers.

Embodiments of the present invention have been described hereinabove by way of example only. It will be understood that modifications may be made to the detailed embodiments without departing from the scope of the present invention.

We claim:

1. A method of transporting railway track apparatus to or from a target location comprising using a train including a multiple of rail wagons and at least one elongate member associated with the rail track apparatus being carried by the train, which member extends to and is supported by at least three adjacent rail wagons, moving the member in a direction laterally of the member and relative to the rail wagons via at least one hoist mounted on each of the same wagons that the member extends over, and operating all of the hoists to simultaneously lift and laterally unload the elongate member.

2. A method as claimed in claim 1, including the step of preventing the elongate member from moving relative to at least one rail wagon.

3. A method as claimed in claim 1, including the step of preventing the elongate member from moving relative to at least one rail wagon at a location intermediate to the ends of the elongate member.

4. A method as claimed in claim 1, including the step of preventing the elongate member from moving at or mid region of the elongate member.

5. A method as claimed in claim 1, including the step of moving the elongate member in the direction of extent of the elongate member relative to at least one rail wagon in the direction of extent of the elongate member when the train deviates from a straight path.

6. A method as claimed in claim 1, and including the step of supporting the member in a guide in the direction of extent of the elongate member.

7. A method as claimed in claim 1, including the step of slidably mounting the member relative to at least one wagon.

8. A method as claimed in claim 7, and including the step of effecting the slidable mounting by a roller on at least one wagon.

9. A method as claimed in claim 8, and including the step of providing an axis in which the or each roller extends horizontally and perpendicularly to the elongate extent of the member.

10. A method as claimed in claim 1, including the step of releasably securing the member to the train to at least one extent of the member.

11. A method as claimed in claim 1, in which the elongate member comprises a track rail.

12. A method as claimed in claim 11, including the steps of transporting the rail to or from the target location, and unloading the rail.

13. A method as claimed in claim 11, and including the step of the train also carrying sleepers to or from the target site.

14. A method as claimed in claim 13, and including the steps of arranging the elongate member to be detachably connected to a plurality of sleepers and, when connected to a plurality of sleepers, lifting a plurality of sleepers on to or off the wagons.

15. A method as claimed in claim 14, including the step of arranging the elongate member to lift the plurality of sleepers from above.

16. A method as claimed in claim 13, comprising the steps of lifting successively, a first set of sleepers and then at least a second set of sleepers, with the first and second sets being mounted one on top of the other.

17. A method as claimed in claim 11, comprising the steps of unloading sleepers at a target location and then unloading at least one rail at the target location.

18. A method as claimed in claim 11, comprising the steps of unloading a first set of sleepers at a first target location, moving the train and unloading a second set of sleepers at a second target location, and returning the train to the first target location and unloading at least one rail at that first target location.

19. Railway track transporting apparatus, including a train having a multiple of rail wagons and at least one elongate member associated with the trail track apparatus being carried by the train, the elongate member extending to and supported by at least three adjacent rail wagons, characterized in that each of said rail wagons that the member extends over includes at least one hoist mounted thereon, and all of said the hoists on said wagons being arranged and configured to simultaneously lift and laterally unload the elongate member.

20. A method of transporting rails to, and leaving those rails at, a target location comprising the steps of using a train including a multiple of rail wagons with each of the rail wagons including at least one winch, supporting the rails with each of the rails extending over and supported by at least three successive wagons and with the rail being movable relative to at least one wagon in the direction of elongate extent of the rail, and using all of the winches on the wagons to simultaneously unload the rails in a direction laterally of the rails at the target location.

21. A method as claimed in claim 20, comprising the steps of first unloading an upper set of sleepers at the target location, moving the train to a second target location, and unloading a second set of sleepers mounted beneath the first set and then returning to the first target location and unloading rails.

22. A method of transporting rails and sleepers to, and leaving those rails and sleepers at a target location comprising the steps of using a train including a multiple of rail wagons with each wagon including at least a winch, moving the train to the target location, supporting the rails on at least three successive wagons with each rail extending over and supported by the at least three successive wagons and with the rails being movable relative to at least one wagon in the direction of elongate extent of the rails, unloading sleepers mounted on the wagons above the rails, and using all of the winches on the wagons to simultaneously unload rails in a direction laterally of the rails at the target location.

* * * * *